US008967688B2

(12) United States Patent
Wilson

(10) Patent No.: US 8,967,688 B2
(45) Date of Patent: Mar. 3, 2015

(54) DEVICE AND METHOD FOR COLLECTION OF MATERIAL FROM A SURFACE

(76) Inventor: Graham J. Wilson, Merseyside (GB)

( * ) Notice: Subject to any disclaimer, the term of this patent is extended or adjusted under 35 U.S.C. 154(b) by 0 days.

(21) Appl. No.: 14/236,508

(22) PCT Filed: Jul. 31, 2012

(86) PCT No.: PCT/GB2012/051855
§ 371 (c)(1),
(2), (4) Date: Jan. 31, 2014

(87) PCT Pub. No.: WO2013/017871
PCT Pub. Date: Feb. 7, 2013

(65) Prior Publication Data

US 2014/0152033 A1 Jun. 5, 2014

(30) Foreign Application Priority Data

Aug. 2, 2011 (GB) ..... 1113298.2

(51) Int. Cl.
*E01H 1/12* (2006.01)

(52) U.S. Cl.
CPC ..... *E01H 1/1206* (2013.01); *E01H 2001/1293* (2013.01)
USPC ..... 294/1.3; 294/1.4

(58) Field of Classification Search
CPC ..... E01H 1/1206; E01H 2001/1293
USPC ..... 294/1.3, 1.4, 86.4, 100
See application file for complete search history.

(56) References Cited

U.S. PATENT DOCUMENTS

| | | | | |
|---|---|---|---|---|
| 4,078,838 | A * | 3/1978 | Nadratowski | 294/1.4 |
| 4,119,337 | A * | 10/1978 | Sherhandt | 294/1.4 |
| 4,253,691 | A | 3/1981 | Liu | |
| 7,080,863 | B2 * | 7/2006 | Cappellano et al. | 294/1.4 |
| 7,226,098 | B1 * | 6/2007 | Moreira | 294/1.4 |
| 7,293,810 | B2 * | 11/2007 | Lopoukhine et al. | 294/1.4 |
| 7,726,716 | B2 * | 6/2010 | Shuttleworth | 294/86.4 |
| 2002/0113448 | A1 * | 8/2002 | Kazerooni et al. | 294/86.4 |
| 2004/0188443 | A1 | 9/2004 | Perkitny et al. | |

FOREIGN PATENT DOCUMENTS

| | | | |
|---|---|---|---|
| DE | 102007062352 | A1 | 6/2009 |
| GB | 2255492 | A | 11/1992 |

* cited by examiner

*Primary Examiner* — Dean Kramer
(74) *Attorney, Agent, or Firm* — Fox Rothschild LLP

(57) ABSTRACT

The invention provides a device (10, 210, 510) for collecting material from a surface. The device is particularly but not necessarily exclusively suited to collection of animal excreta, it has a jaw arrangement (22, 224, 524) which is able to be opened to define a mouth (28) for receiving the material to be collected, and to be closed to collect the material. A conveyor mechanism (44, 46, 364) is provided for advancing collected material into a housing (12, 512). A liner (33) is placed over the jaw arrangement to separate it from the material being collected. The conveyor mechanism serves to advance the liner along with the material collected therein, whereby the material is able to be collected into the housing and retained in the liner without making contact with surfaces of the device.

17 Claims, 15 Drawing Sheets

FIGURE 9
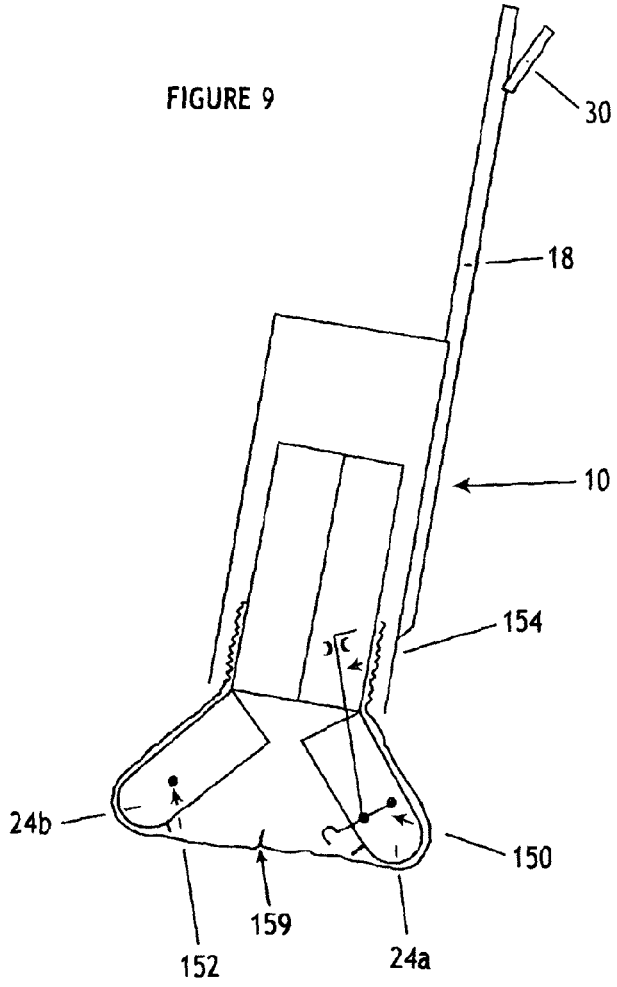
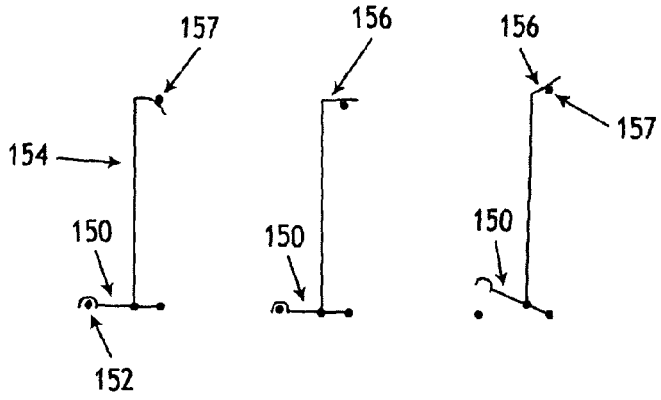
FIG 10a FIG 10b FIG 10c

FIGURE 20
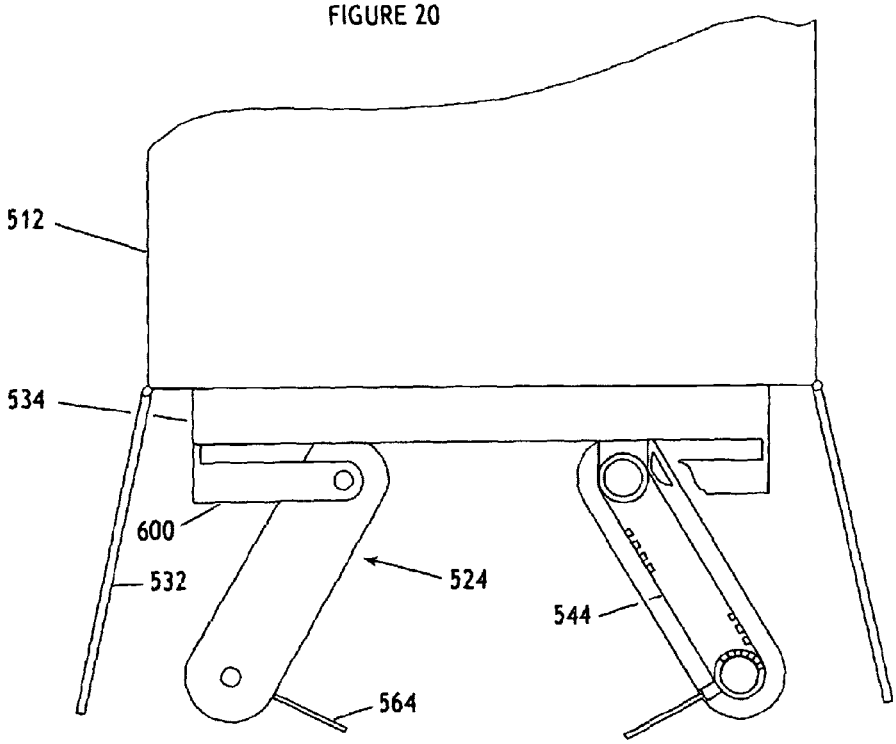
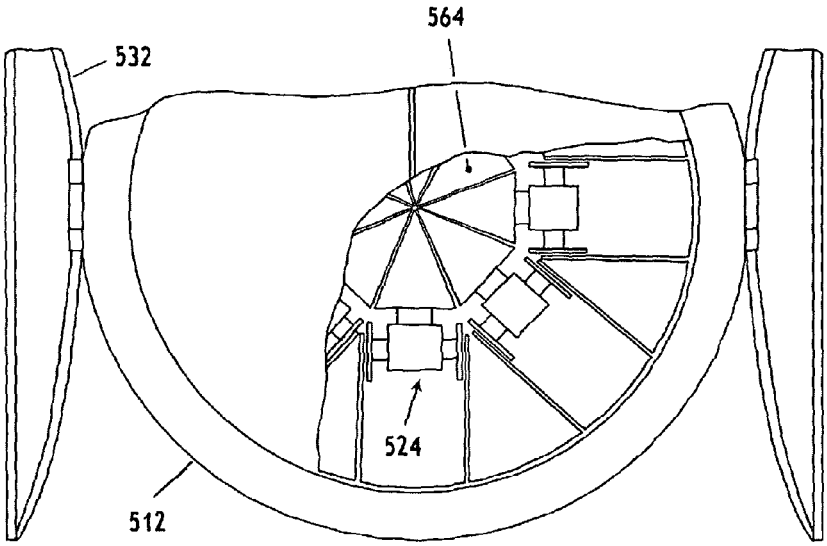
FIGURE 21

DEVICE AND METHOD FOR COLLECTION OF MATERIAL FROM A SURFACE

This application is a U.S. National Phase of International Application No. PCT/GB2012/051855, filed on Jul. 31, 2012, which claims priority of GB1113298.2, filed on Aug. 2, 2011. The contents of the applications are incorporated herein by reference in their entirety.

The present invention concerns a device and method for collecting material from a surface, and a liner for use with such a device.

The present invention is particularly, although not exclusively, applicable to the collection of animal faeces. The problems involved are well known to dog owners. It is difficult to prevent dogs from defecating indiscriminately. In urban environments dog walkers are often required to collect their pets' faeces and carry them to a suitable point of disposal.

To avoid direct contact with the faeces, it is a common practice to cover one hand with a plastic bag and grab the material, then pull the bag over the hand, turning it inside out in the process, so that the material is contained in the bag, whose open mouth can then be tied. The practice suffers from several drawbacks:

a. feeling the warm faeces through the bag is distasteful to some;
b. the pet owner has to bend down to pick the waste up;
c. the collected material must be carried to a point of disposal, and often for the rest of the walk, in a bag which may not be completely sealed, leading to a risk of leakage; and
d. the bag may be broken or ruptured, e.g. by use on rough ground or while being carried. Contact of the faeces with the pet owner's fingers, clothing etc causes risk of exposure to serious pathogens.

There are existing devices for use in collecting animal faeces. One can of course use a shovel, dustpan and brush, pet vacuum cleaner etc. The problem with such tools is that their surfaces are exposed to the material being collected and so become contaminated, requiring subsequent cleaning, which again exposes users to pathogens in the faeces which can cause serious illness. There are also various "scoop" devices on the market. An example is sold under the trade mark Flexrake 33P and has an elongate handle with a pair of pivotally mounted, scoop-shaped jaws at one end. A push/pull rod running along the handle is connected at one end to a user-movable grip and at the other end to the jaws, so that by moving the grip the user can draw the jaws together around the material to be collected. No provision appears to be made for retention of the collected material, which would thus need to be subsequently deposited in a suitable container. Also it appears that the jaws of the device must become contaminated by the collected material.

Another device for collection of dog faeces is marketed by Poopsta of Lancashire, England, and comprises a hollow cylindrical housing with an open end which is to be covered by a plastic bag. An elastic band is placed around the housing and the bag to ready the device for use. The housing's open end is then placed upon the ground, over the animal waste, and depressed, causing the elastic band to slip off the housing and contract, sliding the open end of the bag under the waste and causing it to be captured in the bag, which can then be placed within the housing by the user. A removable lid is then used to close the housing. The device has the advantage that the only surface which contacts the animal faeces is the interior of the plastic bag. Shortcomings include the number of operations that the user must carry out during each use, involving removal of the lid, placing the plastic bag over the housing's open end, placing the elastic band around it, placing the device over the waste and depressing it, placing the bag and collected faeces in the housing, and replacing the lid. Also the operation requires the user to bend or stoop to place the housing in position on the ground. The number of times that the device can be used without being emptied is limited.

An object of the present invention is to provide an improved device for collection of material, particularly but not exclusively waste material and still more particularly animal faeces. It is particularly desired to provide a device capable of repeated and convenient use. It is also desired to provide a device for collection of material which is able to operate without becoming contaminated by the material being collected.

In accordance with a first aspect of the present invention, there is a device for collecting material from a surface, the device comprising a housing for receiving collected material, a jaw arrangement which is able to be opened to provide a mouth for receiving the material and closed to collect the material, and a conveyor mechanism for advancing a liner, placed over the jaw arrangement to separate it from the material being collected, into the mouth, along with material collected therein, whereby the material is able to be collected into the housing and retained in the liner without making contact with surfaces of the device.

The invention allows the jaws, which would otherwise become contaminated by the collected material, to be covered by the liner. The collected material can be contained by the liner and moved into the housing for transport/storage/disposal without any need for the user to handle it and without contaminating any internal parts of the device.

It is especially preferred that the conveyor mechanism is operable when the jaw mechanism is closed. In this way the jaws can be closed around the collected material and then, in a separate and subsequent action, the conveyor can be operated to advance the liner and the collected material into the housing.

It is also preferred that the jaw mechanism and the conveyor mechanism are independently operable, so that the jaw mechanism is able to be opened and closed without advancing the liner. In this way the user can if need be try more than once to close the jaws around the material in order to collect it, before actuating the conveyor to move the material into the housing.

According to a second aspect of the present invention there is a liner for use with a collection device, the liner comprising an elongate tube of flexible material which is crushed, concertinaed or otherwise compacted to form a frame with an opening, allowing the frame to be placed around a part of the collection device for mounting.

The "frame" in question may for example be circular or square. It may be supported by some form of frame member additional to the liner itself, but this is not required.

In one embodiment the liner has, at intervals along its length, sealing strips able to form a seal across the liner when pressed against themselves. The sealing strips may be self adhesive strips or zips.

Specific embodiments of the present invention will now be described, by way of example only, with reference to the accompanying drawings, in which:

FIGS. 1*a* to 1*e* are simplified perspective illustrations of a first collection device embodying the present invention at successive points in its operation;

FIGS. 2*a* to 2*c* are sections through the same collection device taken in a vertical plane and again showing successive stages in the devices' operation;

Figure 7A:
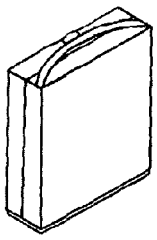
Figure 7B:
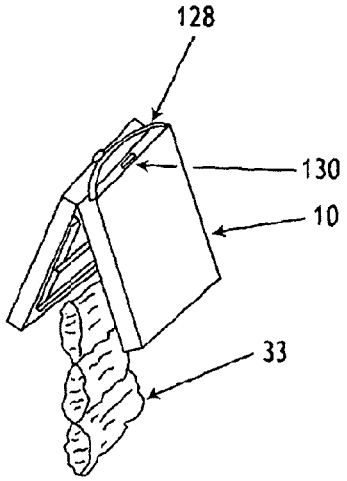
Figure 8:
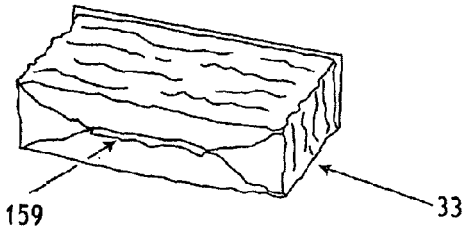
Figure 11:
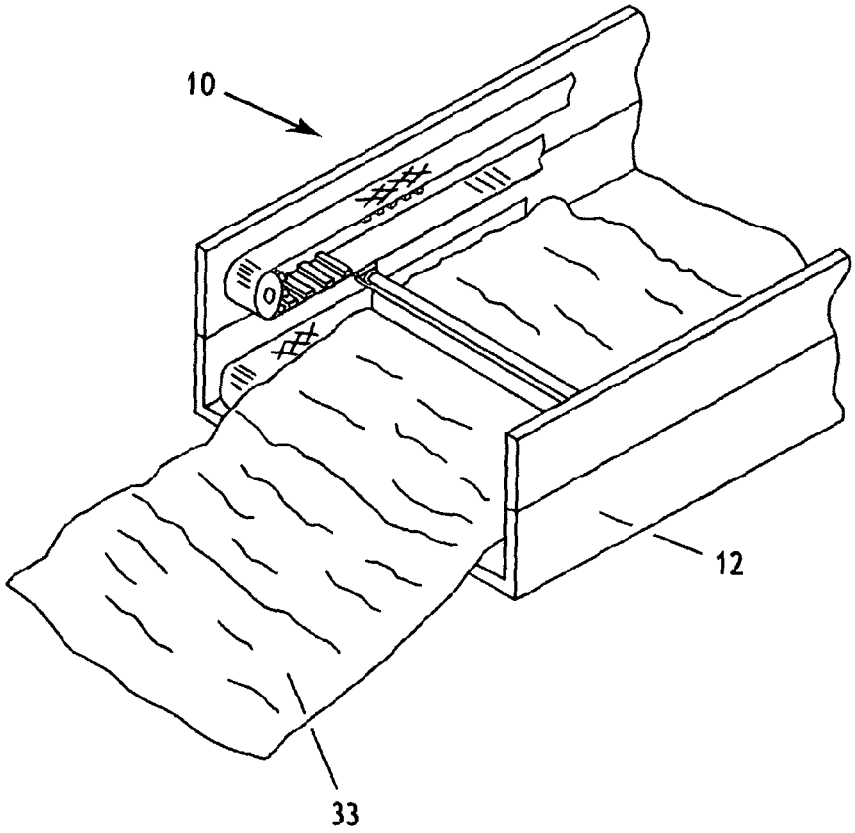
Figure 13:
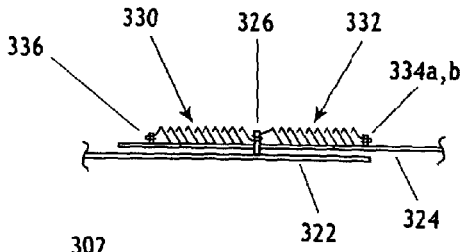
Figure 12:
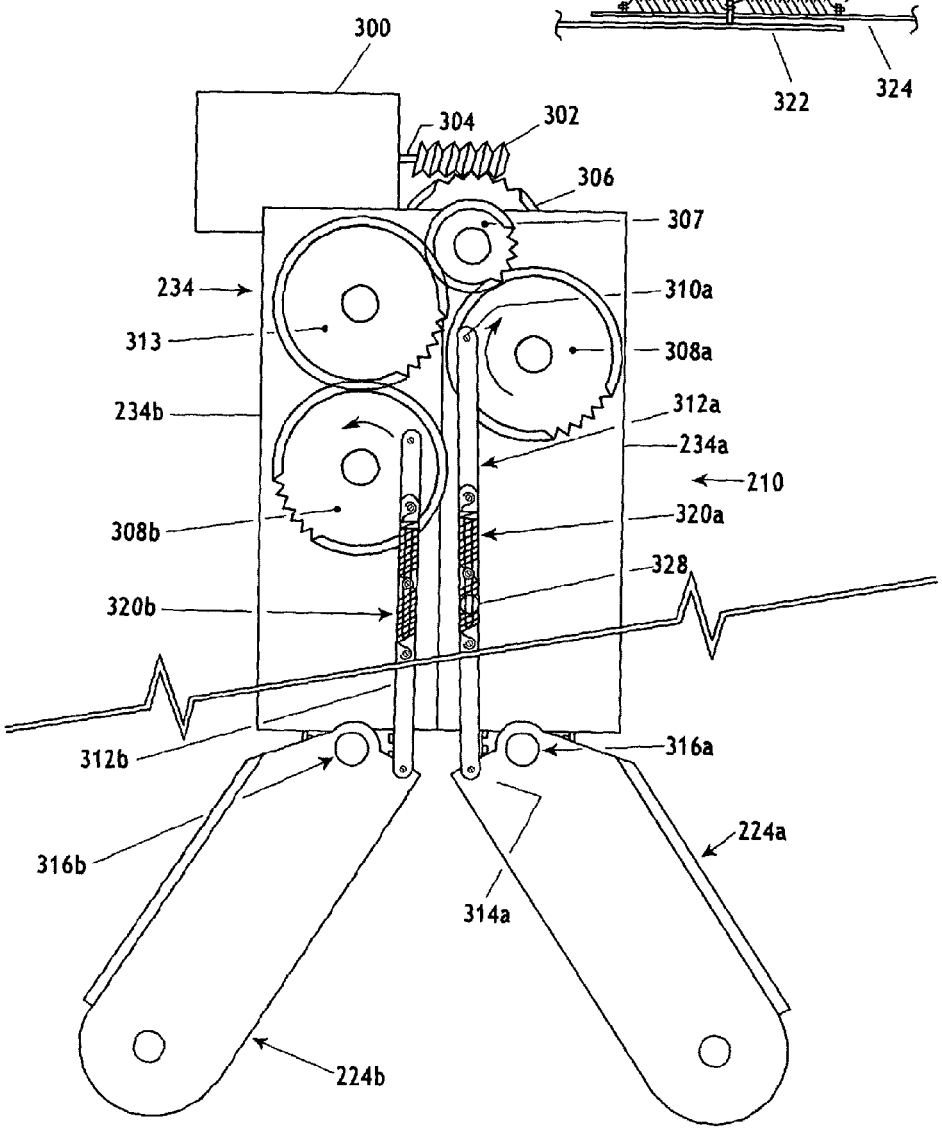
Figure 14:
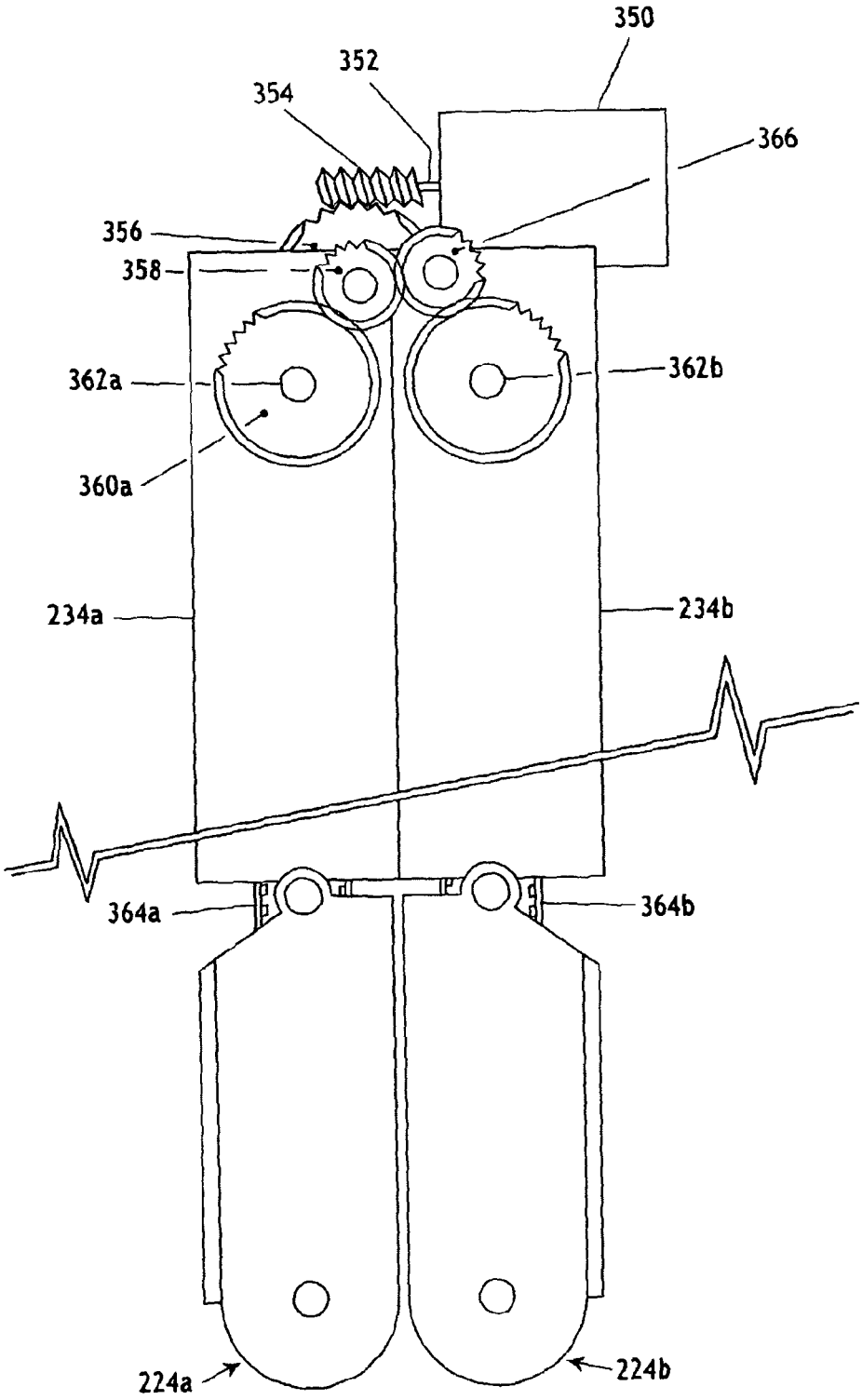
Figure 15:
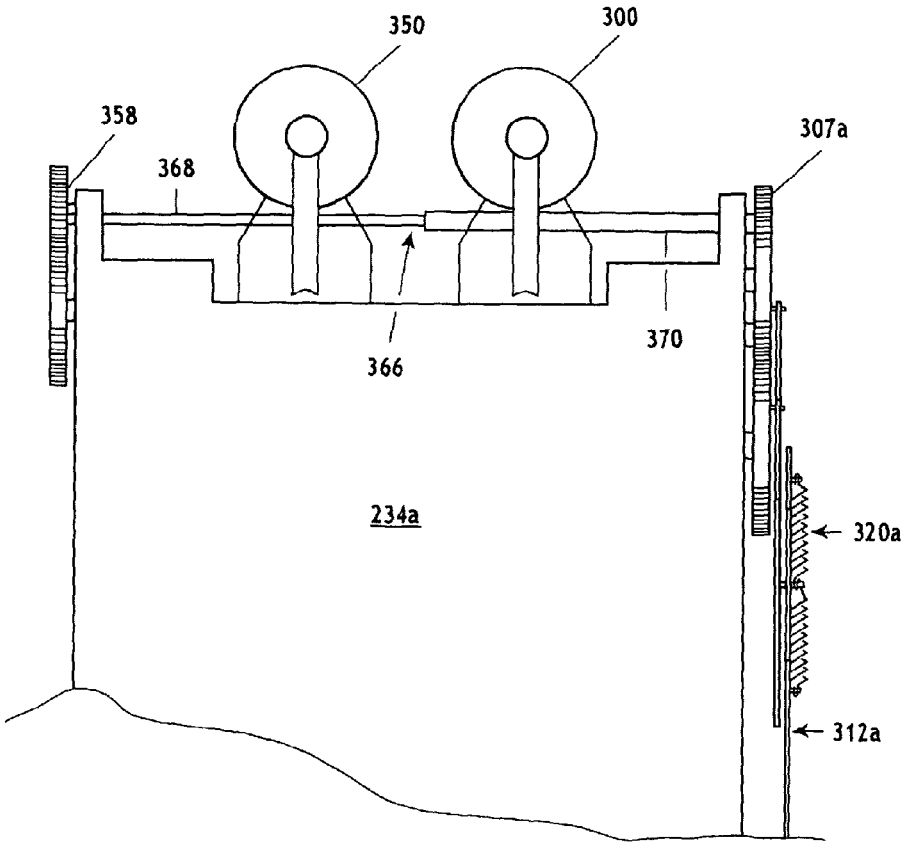
Figure 16:
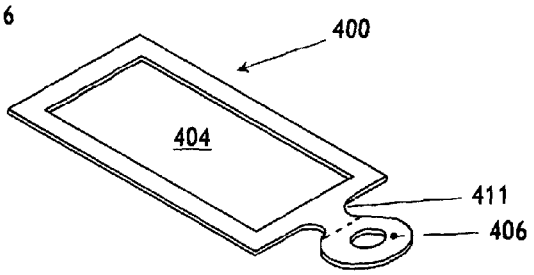
Figure 17:
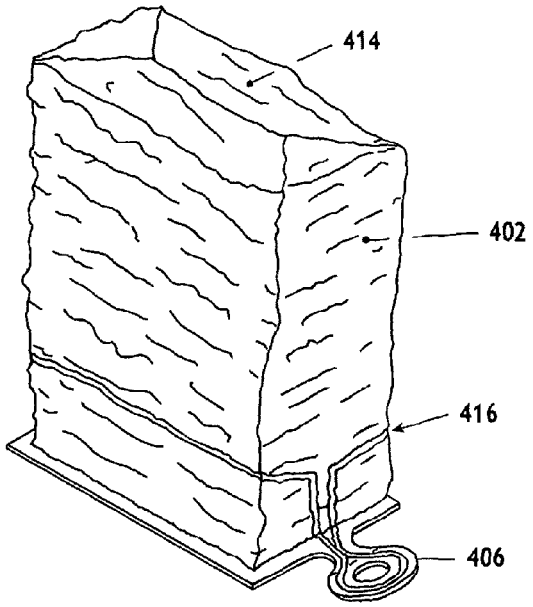
Figure 18:
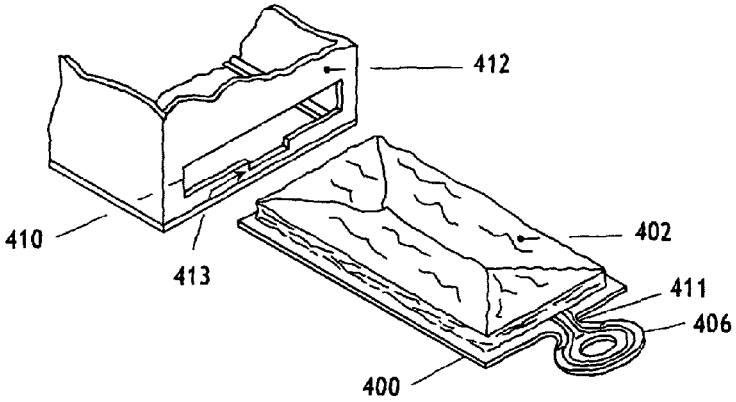
Figure 19:
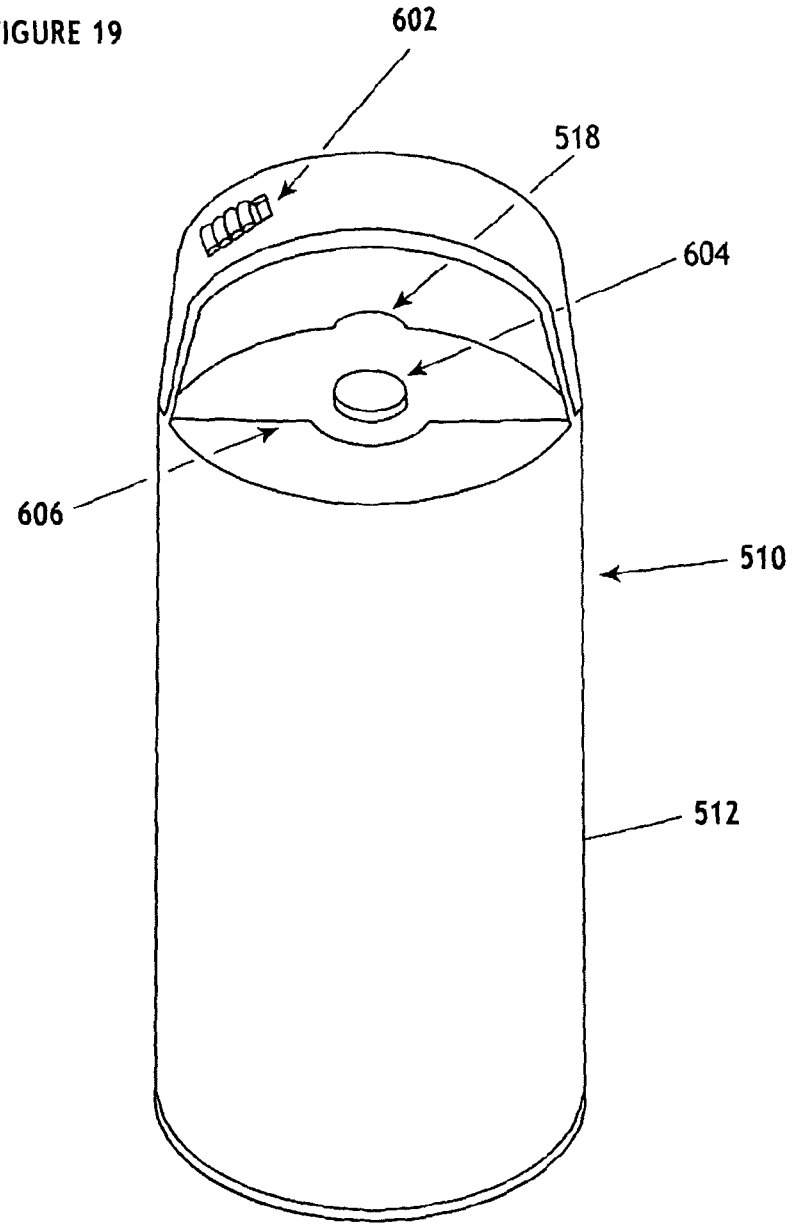

FIGS. 7*a* and 7*b* are simplified perspective views of the device showing how it can be opened to eject collected material;

FIG. 8 shows a liner for use with the device;

FIG. 9 is a simplified sectional view through the device in a vertical plane, showing details of a latch mechanism;

FIGS. 10*a* to 10*c* represent the latch mechanism on its own and show successive stages in its operation;

FIG. 11 is a perspective illustration of a modified version of the first collection device;

FIG. 12 shows some internal components of a second collection device embodying the present invention, viewed from a first side;

FIG. 13 is an enlarged view of a resilient linkage used in the second collection device;

FIG. 14 is similar to FIG. 12 but shows the device's internal components from a second side, opposite the first;

FIG. 15 shows the same internal components as FIGS. 12 and 14, viewed from the front of the device;

FIG. 16 is a perspective illustration of a former for carrying a liner for use in a collection device embodying the present invention, the liner itself being omitted;

FIG. 17 is similar to FIG. 16 but additionally includes the liner, showing it opened out to reveal its shape;

FIG. 18 is a perspective illustration of the former, the liner, this time in a compact, pre-use configuration, and of a portion of a housing of a collection device which is adapted to receive the liner;

FIG. 19 is a perspective illustration of a third collection device embodying the present invention;

FIG. 20 shows a lower part of the third collection device viewed from one side and partly in section; and FIG. 21 shows the third collection device viewed from above, parts of the device being cut away to reveal details of its interior.

The collection devices illustrated in the drawings are all intended for collection and carrying of animal faeces. In particular they are usable by dog walkers to collect dog faeces from the ground and allow them to be safely transported to a bin or other waste disposal facility. Such devices are colloquially referred to as "poop scoops". Note however that the present invention has potential applications in other fields, as will be explained below.

Figure 1A:
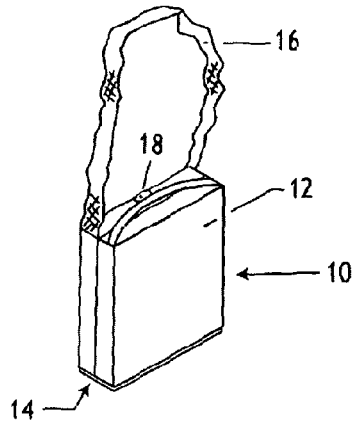

FIGS. 1*a* to 1*e* illustrate some major components of a first collection device 10 embodying the present invention and show the sequence of steps in the device's operation. In FIG. 1*a* the device 10 is configured for carrying. It can be seen to comprise a housing 12, which in the present embodiment is generally cuboidal and is spilt along a line 14 into two separable parts. Other shapes and configurations of the housing are possible. The device can be provided with some form of strap or other means to facilitate carrying and in the present embodiment this takes the form of a shoulder strap 16. The device has an extensible handle 18 whose end only is seen in FIG. 1*a*, the remainder of the handle being contained in the housing 12 so that the device forms a relatively compact shape which can be conveniently carried.

Figure 1B:
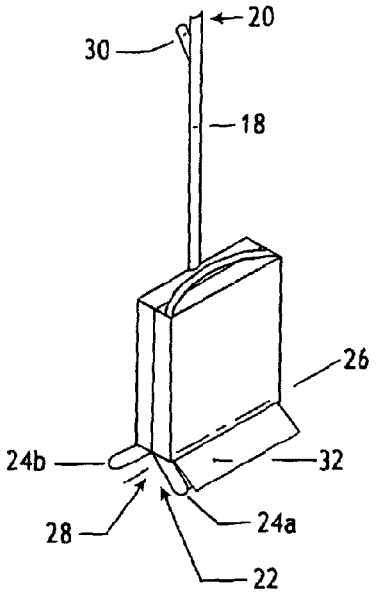

To ready the device 10 for use (FIG. 1*b*) the extensible handle 18 is drawn out of the housing 12. The user can hold the device at upper end 20 of the handle 18 and because the handle is elongated it is not necessary for the user to stoop or bend to collect waste material from the ground. Also seen in FIG. 1*b* is a jaw arrangement 22. When the device is configured for carrying (FIG. 1*a*) the jaw arrangement 22 is contained within the housing 12. The action of withdrawing the handle 18 causes the jaw arrangement 22 to be advanced downwardly out of the housing 12, and also to be opened ready for use in collecting waste material. In the illustrated embodiment the jaw arrangement comprises a pair of jaws 24*a*, 24*b* which are each pivotally mounted. The axis about which jaw 24*a* pivots is indicated at 26 in FIG. 1*b*. Other jaw configurations could be adopted. For example the arrangement could use a single movable jaw arranged to cooperate with a fixed jaw to collect waste material. The term "jaw" in this context refers to any part shaped and arranged to scoop or otherwise collect the waste material from the ground surface. In the jaws' open configuration they form a mouth 28 for receiving the waste material. The user places the device over the material to be collected (which is not shown in FIG. 1) with the material in the mouth 28. Lower edges of the jaws 24*a*, 24*b* are preferably in contact with the ground surface at this point.

Figure 1C:
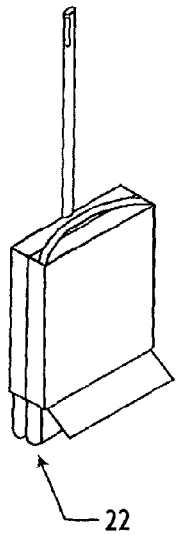
Figure 1D:
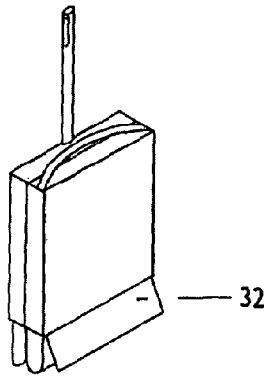
Figure 1E:
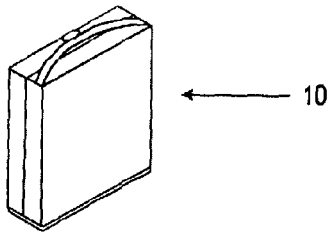

A user-operable actuating part is provided to enable the user to close the jaws. In the illustrated embodiment this takes the form of a user-operable lever 30 toward the upper end of extensible handle 18. The lever 30 is automatically deployed when the handle 18 is extended from the housing 12. To this end, in the illustrated embodiment, the lever 30 is sprung toward an open position (FIG. 1*b*). Gripping the lever 30 causes the jaw arrangement 22 to close, as seen in FIG. 1*c*, collecting the waste material between the jaws.

Once the material has been collected into the jaws in this manner, the user can cause the material to be advanced into the housing for storage. In the illustrated embodiment the action of pushing the handle 18 into its stowed position within the housing 12 causes the jaw arrangement 22 to retract into the housing and at the same time, in a manner to be explained below, advances the waste material into the housing 12. A hinged flap 32 closes the otherwise open lower end of the housing 12 when the jaw arrangement 22 is retracted—see FIG. 1*d*. After use the device 10 is returned to its carrying configuration—FIG. 1*e*.

An important aspect of the device not seen in FIG. 1 relates to its use of a liner 33 to cover the jaw arrangement and so separate it from the material being collected, so that contamination by the waste material is limited to the liner, with no surfaces of the device 10 itself needing to be brought into contact with the waste material being collected. This aspect, and the details of the device's internal mechanism, will now be explained with particular references to FIGS. 2 to 6.

Figure 2A:
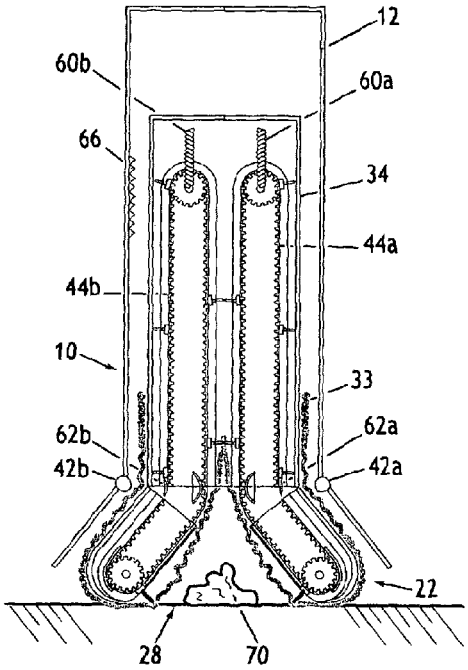
Figure 2B:
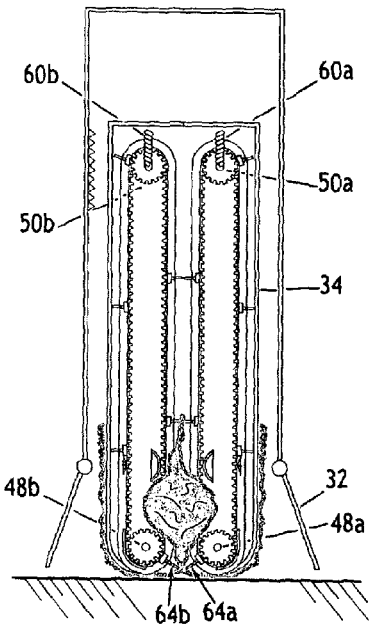
Figure 2C:
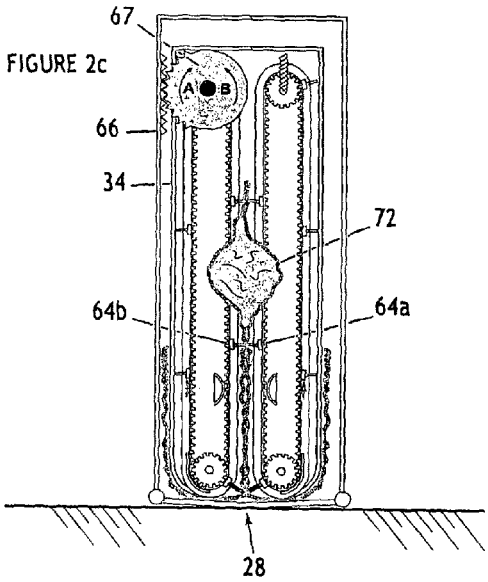

The liner 33 can be seen for example in FIGS. 2*a* to 2*c*. In the present embodiment the liner 33 is formed as an elongate tube. It comprises flexible and preferably impermeable sheet material. In the illustrated embodiment the material is thin plastics akin to the material of a plastic bag. Polyethylene film is one suitable material although there are many others. The liner 33 is passed around and over the jaw arrangement 22, back through the jaw arrangement's mouth 28 and so into the interior of the housing 12. The above-mentioned step of advancing the collected waste material into the housing 12 involves advancing the liner 33, with the waste material contained in it, into the housing. The liner 33 thus contains the waste material within the housing 12, preventing the material from contaminating the device's interior.

Figure 3:
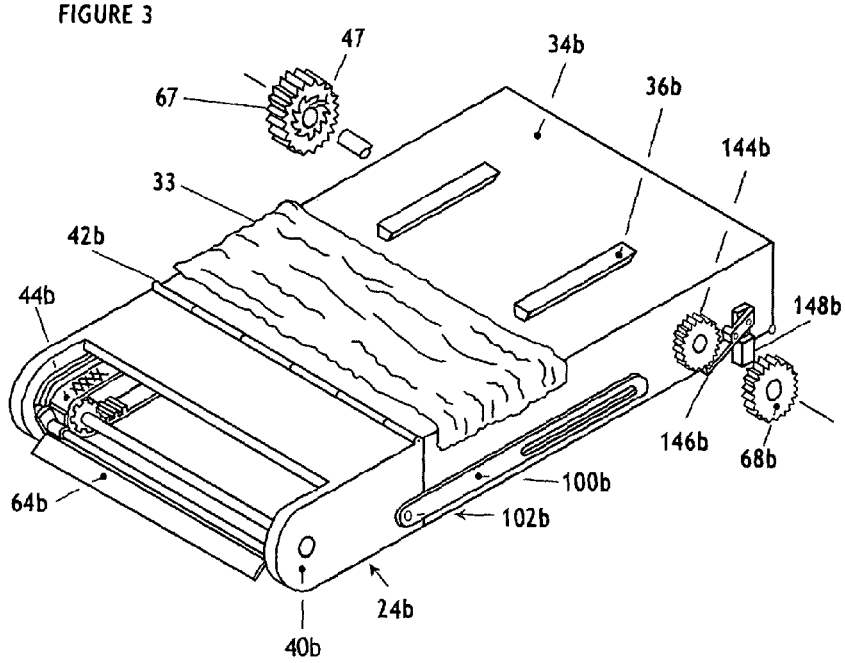
FIG. 3 is an exploded view of an internal sliding casing of the same device and includes various working parts carried by the sliding casing.
Figure 3:
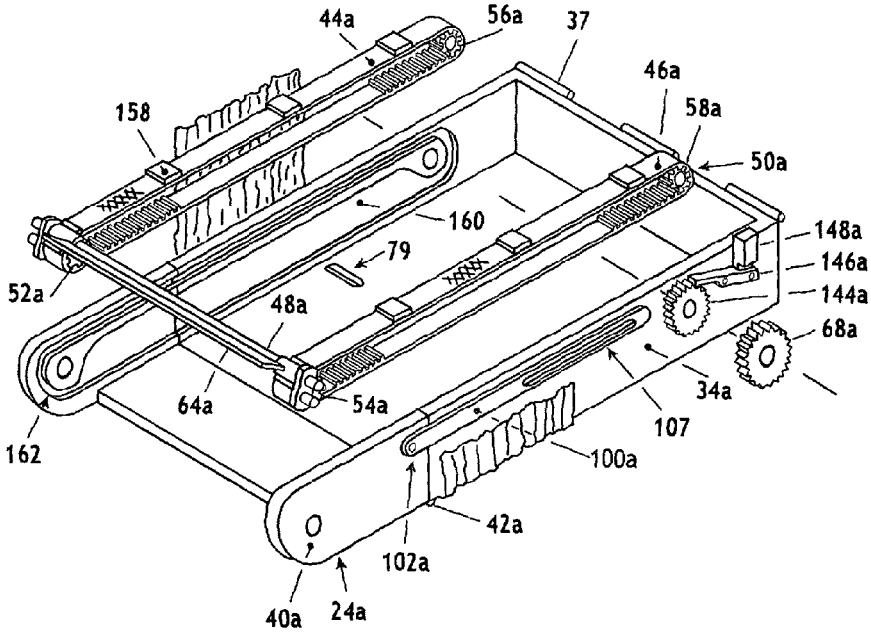

Looking at FIG. 2 in more detail, it can be seen that the device comprises a sliding assembly mounted in the housing 12 and incorporating the jaw arrangement 22. In the illustrated embodiment this sliding assembly comprises a sliding casing 34 which is movable up and down within the housing 12 to advance/retract the jaw arrangement 22. Details of the sliding assembly are illustrated in FIG. 3. The sliding casing 34 is a box-like hollow structure formed in two parts which are separated from one another in FIG. 3 and designated 34*a* and 34*b* in that drawing. Runners 36*b* formed on second part 34*b* of the sliding casing have a dovetailed or otherwise undercut cross section. Complementarily formed guideways 38 are provided upon a second part 12*a* of the housing 12 (see FIG. 4) to receive the runners 36*b* and so slidably mount the second casing part to the second housing part. The first casing part 34*a* is attached to the second casing part 34*b* through a hinge 37 (FIG. 3) and is loosely tethered to the first housing part 12*a* so that when the housing 12 is opened, the sliding casing 34 opens along with it. When the housing 12 is closed for use, the two casing parts 34*a*, 34*b* mechanically engage with one another and so move as a unit.

Each of the casing parts 34*a*, 34*b* carries one of the jaws 24*a*, 24*b*. In FIG. 3 it can be seen that each of the jaws 24*a*, 24*b* comprises a lower casing portion 40*a*, 40*b* pivotally attached to the remainder of its respective casing part 34*a*, 34*b* through a respective hinge 42*a*, 42*b*.

Advancement of the liner 33, and of the collected material, into the housing 12 is managed by means of a set of conveyors formed in the present embodiment as belts 44, 46. The relevant components carried by the first casing part 34*a* will now be described. Components carried by the first casing part 34*a* are denoted, in the following paragraphs, by the suffix "a." It is to be understood however that the second casing part 34*b* has a similar arrangement of belts and associated parts and in the drawings these are denoted by the suffix "b".

The first casing part 34*a* carries a pair of belts 44*a*, 46*a* which are laterally separated from one another. The belts are carried upon lower and upper axle assemblies 48*a*, 50*a* (the terms "upper" and "lower" refer herein to the orientation of the device in which it is seen in FIG. 1, with the jaws lowermost). The lower axle assembly 48*a* is carried by the first jaw 24*a* toward its lower end. The lower axle assembly 48*a* carries a pair of pinions 52*a*, 54*a* upon which the respective belts 44*a*, 46*a* are mounted and the belts are internally toothed to engage with the pinions, providing positive drive without slip, so that the device's four belts move in step with one another. The upper axle assembly 50*a* is mounted by and within the sliding casing 34, at or at least toward its upper end, and carries a further pair of pinions 56*a*, 58*a* upon which the respective belts 44*a*, 46*a* are mounted. To maintain belt tension as the jaws are opened and closed, the upper axle assembly 50*a* is movable and is acted upon by tension springs 60*a* (see FIG. 2). Comparing FIGS. 2*a* and 2*b* it can be seen that these springs are extended when the jaw 24*a* is in its open position (FIG. 2*a*) and contract, drawing the upper axle assembly 50*a* upwards to maintain belt tension, when the jaw moves to its closed position (FIG. 2*b*). Guides 62*a* formed within the sliding housing 34 constrain the paths taken by the belts 44, 46 in the vicinity of the hinges 42 and prevent the belts from rubbing on other parts of the device when the jaws 24*a*, 24*b* are opened (see FIG. 2*a* in particular).

The two belts 44*a*, 46*a* carried by the first casing part 34*a* are linked to one another by a set of collecting paddles 64*a*. The term "paddles" as used herein does not in itself imply any particular shape for these components, which could take any of a number of different forms commensurate with their function. In the illustrated embodiment they are formed as elongate slender panels standing up from the belts' outer faces.

As noted above, the second casing part 34*b* carries its own arrangement of second belts 44*b*, 46*b*; second upper and lower axle assemblies 48*b*, 50*b*; second pinions 52-58*b*; second tension springs 60*b* and second guides 62*b*, all of them similarly formed to the corresponding parts carried by the first casing part 34*a*.

A mechanism is provided for advancing the two sets of belts 44*a*, 46*a* and 44*b*, 46*b* together. In the illustrated embodiment, this is achieved by means of a rack and pinion drive whose rack 66 is carried by, and within, the housing 12 and meshes with a pinion 67 mounted on the second upper axle assembly 50*b* to drive it, and so drive the second belts 44*b*, 46*b*. To transfer drive to the first belts 44*a*, 46*a*, the second upper axle 50*b* carries, on the side of the casing 34 opposite the rack and pinion drive, a transfer gear 66*b* which meshes with an identical transfer gear 68*a* carried by the first upper axle assembly 50*a* (see FIG. 3 in particular). A ratchet mechanism 47 (see FIG. 3) ensures that the axle assemblies 50*a*, 50*b*, and the belts 44*a*, 46*a*, 44*b*, 46*b* that they carry, can turn only in one direction. In FIG. 2*b*, the first upper axle assembly 50*a* is able only to turn clockwise and the second upper axle assembly 50*b* only anticlockwise, causing the liner 33 to advance into the housing 12.

The manner in which collected waste material is advanced into the housing 12 can now be understood, referring once more to FIGS. 2*a* to 2*c*. After the jaw arrangement 22 has been closed (FIG. 2*b*), the sliding casing 34 is withdrawn into the housing 12. This motion of the casing 34 causes the axle assemblies 48, 60 to turn, advancing the belts 44, 46. At the beginning of this motion, a pair of first and second paddles 64*a*, 64*b* lie opposite and adjacent one another and at lower ends of their respective jaws 24*a*, 24*b*. These paddles collect and contain the waste material, which is item 70 in FIG. 2. As the belts advance, the waste material and the liner 33 around it are moved, by the action of the paddles 64*a*, 64*b*, into the device's interior. Note that by virtue of the lateral separation of the pairs of belts 44, 46 (seen in FIG. 3), the waste material is not squeezed between the belts but instead is allowed to occupy as much of the volume within the sliding casing 34 as it requires, causing the liner 33 to correspondingly bulge, as seen at 72 in FIG. 2*c*, whilst at the same time being retained between pairs of paddles 64*a*, 64*b* above and below.

A mechanism is provided to move the sliding casing 34 between the retracted position of FIG. 2*c* and the advanced position of FIGS. 2*a* and 2*b*. This mechanism can best be seen in FIG. 4. As noted above, in the illustrated embodiment it is the act of extending/retracting the handle 18 that causes the sliding casing 34 and the jaw arrangement 22 to advance/retract. However the distance through which the handle 18 moves is larger than the distance through which the sliding casing 34 moves. One solution to this problem would be to have the handle 18 engage with the casing 34 for only a short part of its stroke. However a more elegant solution, providing the user with mechanical advantage in the actuation of the mechanism, is found in the present embodiment. A pair of actuating levers 76, 78 is carried upon the second housing part 12*b*. Each lever pivots about a respective fulcrum 80, 82 which is fixed with respect to the housing 12. Each has a respective slot 84, 86 running along its length. The handle 18 carries an actuating pin 88 which is received in both slots 84, 86 as a sliding fit. On the opposite side of the fulcrum 80, 82 from the actuating pin 88, each actuating lever 76, 78 has a respective engagement pin 90, 92 which projects into a corresponding lateral slot 79 formed in the sliding casing 34 (see FIG. 3).

Moving the handle 18 causes the actuating levers 76, 78 to turn and so causes the sliding casing 34 to move up/down. Note that the mechanism provides a reverse: of direction—when the handle 18 is moved downward, to retract it, the sliding casing 34 moves upward, to correspondingly retract the jaw arrangement 22. Also because a distance between the fulcrum 76 or 78 and the actuating pin 88 is longer than the distance between the fulcrum 76 or 78 and the respective engagement pin 90, 92 the mechanism provides the required mechanical advantage—that is, the handle 18 moves through a longer stroke than the sliding casing 34.

The handle 18 is coupled to the housing 12 in a manner which provides for its extending/retracting motion. In the illustrated embodiment the handle 18 terminates in a carriage plate 94 slidably mounted between two rails 96 formed within the housing 12.

A user-operable mechanism is provided for closing the jaw arrangement 22. Note in this regard that the user is able to control movement of the jaw arrangement independently of the advancement and retraction of the jaws so that if need be the user can make more than one attempt at closing the jaws around the waste material, before completing the process by retracting the jaws and thereby moving the collected material into the housing 12. Each of the jaws 24*a*, 24*b* is controlled through a respective pair of jaw actuating rods 100*a*, 100*b*. One of each pair can be seen in FIG. 3, being mounted on a side face of the sliding casing 34. The other member of each pair is on the opposite side of the sliding casing 34 and so not seen in the drawing. Each jaw actuating rod 100*a*, 100*b* couples to a respective hinged casing portion 40*a*, 40*b* through a respective pivot 102*a*, 102*b* which is laterally offset from the corresponding hinges 42*a*, 42*b* so that by moving the jaw actuating rods 100*a*, 100*b* the jaws 24*a*, 24*b* can be opened and closed.

Figure 4:
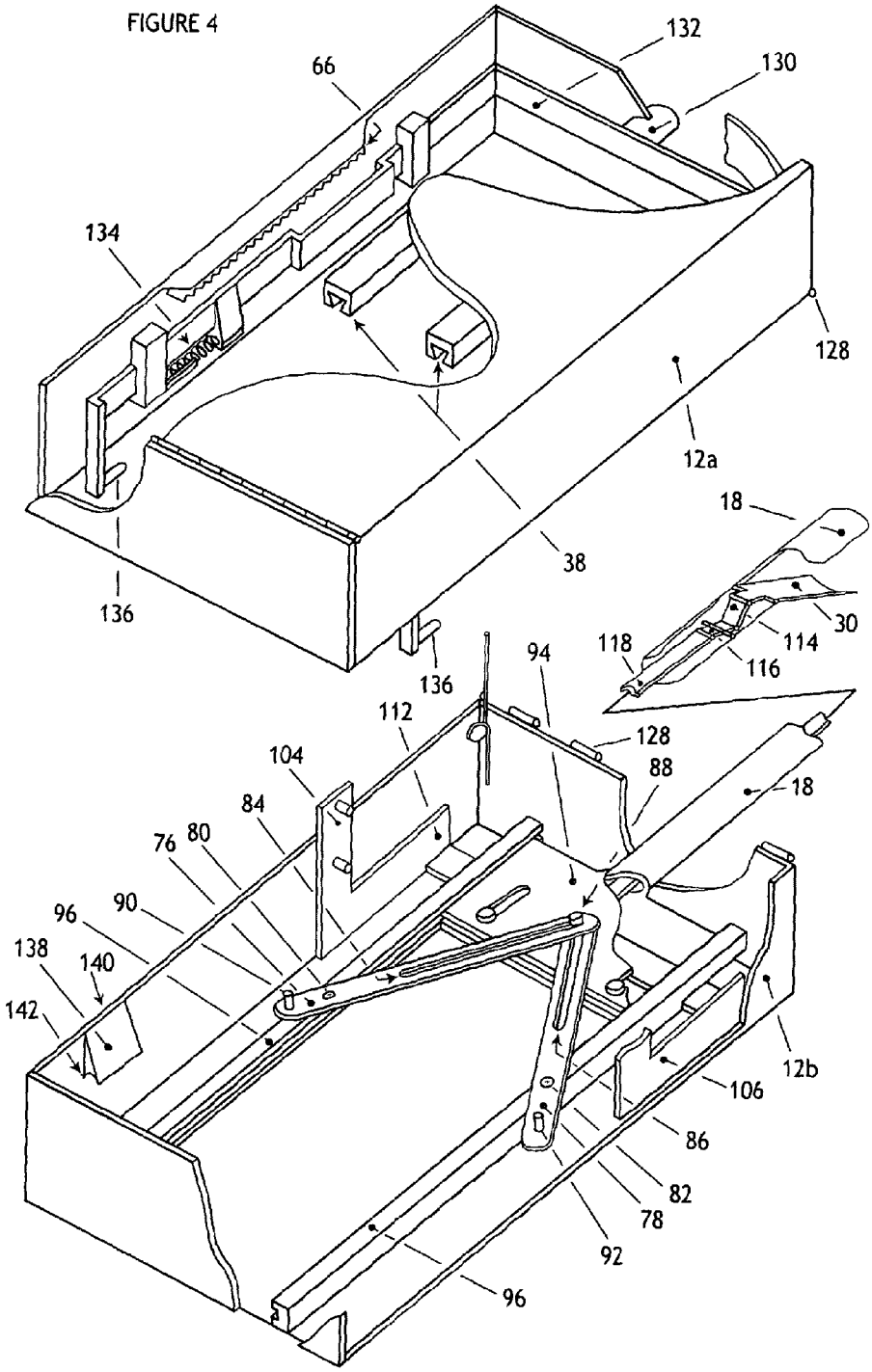
FIG. 4 is an exploded view of an outer housing of the same device and includes various working parts carried by the housing.
Figure 5:
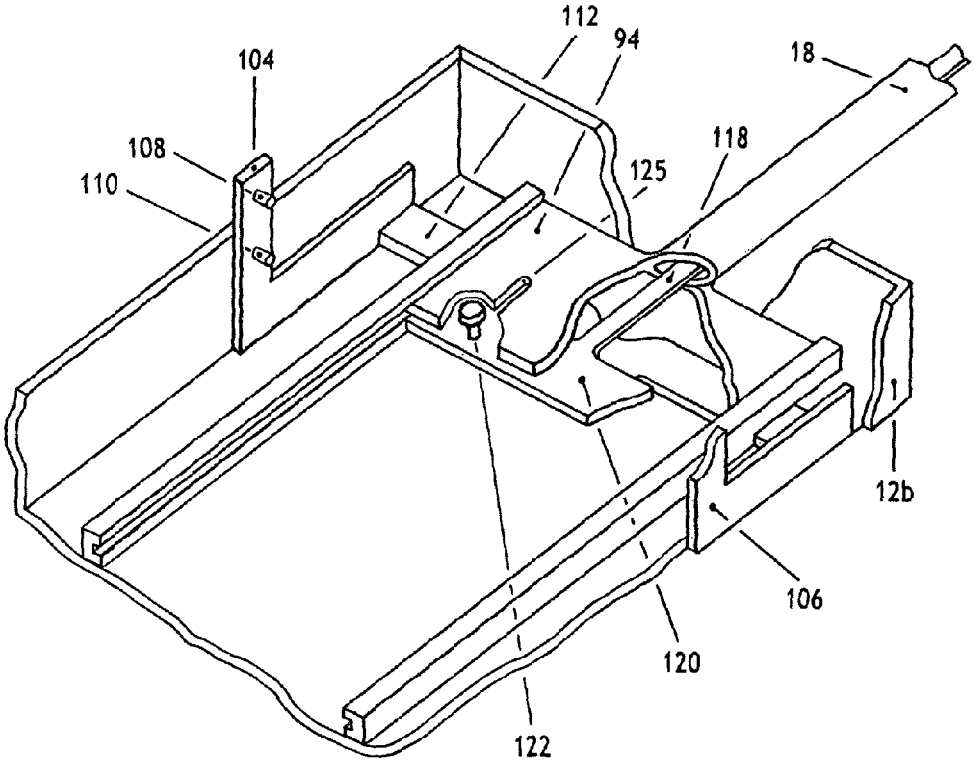
FIG. 5 is a perspective view of part of the device's housing and associated component.
Figure 6:
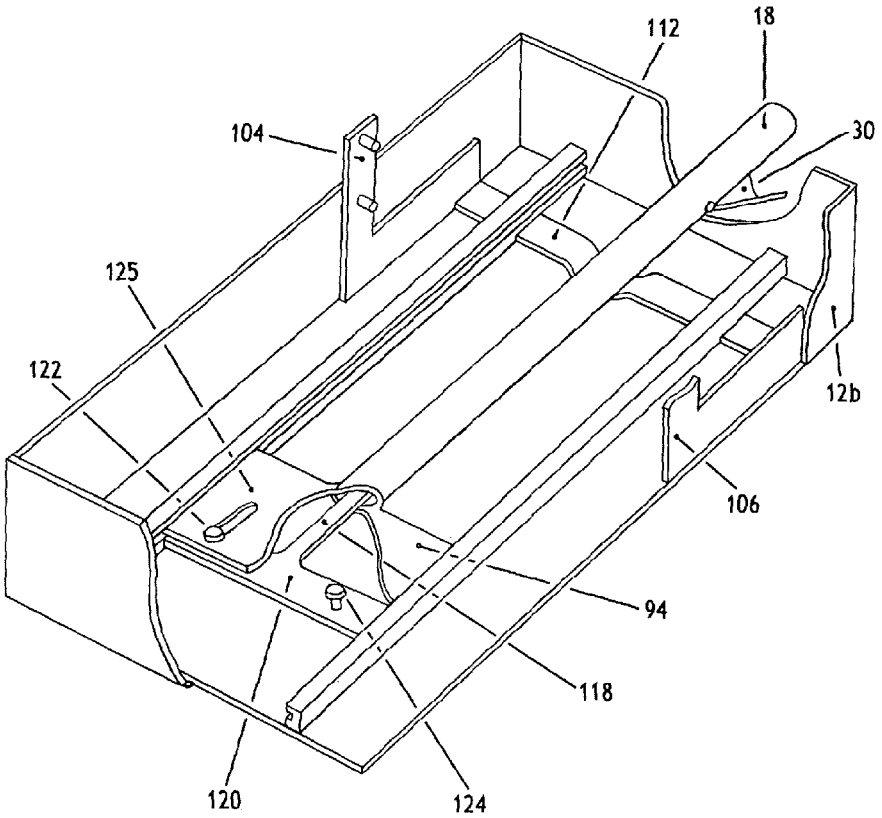
FIG. 6 is similar to FIG. 5 but shows a handle and related parts in a different position.

The jaw actuating rods 100*a*, 100*b* are coupled, through slots in side was of the sliding casing 34, to "L" shaped coupling parts 104, 106 seen in FIGS. 4 to 6 and arranged outside and on opposite sides of the sliding casing 34. FIG. 5 shows pivot rods 108, 110 which pivotally engage with the jaw actuating rods 100. The two coupling parts 104, 106 are linked by a cross member 112 so that they move together to open and close the jaws. The pivot rods 108, 110 are received in slots 107 (see FIG. 3) which provides freedom for the jaw assembly to be retracted.

As explained above, the user closes the jaws by means of a lever 30 which is near the upper end of the extensible handle 18. To this end, the handle 18 is hollow and contains, as seen in FIG. 4, a pair of coupling levers 114, 116 to convert rotational motion of the lever 30 to linear movement of a coupling rod 118 which extends through the handle 18, emerging into the outer housing 12 at the handle's lower end to meet a T bar 120 which is carried beneath the carriage plate 94 through mushroom shaped buttons 122, 124. The buttons slide captively in short slots 125 in the carriage plate 94 to allow the T bar 120 to more relative to the carriage plate 94.

When the user squeezes the lever 30, the coupling rod 118 is drawn upwardly. This motion is transmitted through the T bar 120, abutting the cross member 112, to the coupling parts 104, 106 and so to the jaw actuating rods 100*a*, 100*b* and to the jaws 24*a*, 24*b*, causing them to close.

Note that because the T bar 120 is not coupled to the cross member 112, the mechanism does not hinder retraction of the handle 18 into the housing 12. As seen in FIG. 6, retraction simply causes these parts to move away from one another. The mechanism can thus urge the jaws to close but cannot cause them to open. Opening of the jaws is caused by a spring arrangement which is not seen in the figures but may for example comprise torsion springs acting on the casing portions 40*a*, 40*b*.

The collection device can be used multiple times before it requires emptying. That is, the user can repeat the sequence of steps explained with reference to FIG. 1 twice or more. When the user reaches a suitable waste disposal point, however, the device needs to be emptied. FIGS. 7*a* and 7*b* show one way that this can be done. The housing 12 is formed in two separable parts, as noted above. In the present embodiment these are coupled along their top edges through a housing hinge 128. Opening the housing 12 about the hinge separates the two parts of the sliding casing 34, allowing the collected material, carried in the liner 33, to fall or be removed from the device (FIG. 7*b*).

For the convenience of the user, the present embodiment incorporates a release button 130 used to open the housing 12. In FIG. 4 it can be seen that the release button is mounted in a first part 12*a* of the housing 12, in an upper wall thereof, and is coupled through a release bar 132, which is upwardly biased by a spring 134 and extends around the inner periphery of the housing 12, to a pair of bolts 136 on opposite sides of the device. When the user closes the housing 12 by pushing its two parts together, the bolt 136 first rides along an inclined face 138 of a catch 140 formed on second part 12*b* of the casing, then snaps into an undercut inner face 142 of the catch 140 to secure the casing parts 12*a*, 12*b* together. Depressing the release button 130 causes the bolt 136 to slide downwards, disengaging it from the catch 140 and allowing the housing 12 to open.

Looking at FIG. 2 it will be recognised that the paddles 64*a*, 64*b* carried on opposite parts of the sliding casing 34 need to be aligned in pairs to perform their function. While the housing 12 and the sliding casing 34 are closed, meshing of the drive gear 68 and the driven gear ensures that the paddles advance in step and remain properly aligned. However when the sliding casing 34 is opened these gears are separated and there is the possibility that one will turn relative to the other, taking the paddles out of alignment. To prevent this from happening, a latch mechanism locks the gears when the sliding casing 34 is opened. FIG. 3 shows the details. The upper axle assemblies 50*a, b* each carry a latching gear 144*a, b* associated with a respective locking bar 146*a, b* which is biased toward engagement with its latching gear to prevent rotation. Pushrods 148*a, b* are arranged to disengage the locking bars when the sliding casing 34 is closed. When the sliding casing 34 is opened, the pushrods are released, the locking bars engage and rotation of the gear mechanism is prevented.

Consideration also needs to be given to the manner in which the liner 33 is inserted into the collection device to prepare it for use. The liner 33 may be provided to the user in the form seen in FIG. 8. A length of tubular liner material sufficient for multiple uses is collapsed into a small volume in the manner of a concertina and is carried on a rectangular frame, making it easy to insert the concertinaed lining into the device, around the sliding casing 34. To install the liner 33 ready for use, the end of the liner is pulled downward around the extended and open jaw arrangement 22 and is then fed back into the jaw's open mouth 28. At this point the liner 33 needs to be gripped by the paddles 64 to enable it to be advanced into the collection device. To this end, the device comprises a jaw latch mechanism so that the jaws can be pushed closed by hand, gripping the liner 33, and kept closed while the mechanism is advanced. The latch mechanism automatically releases when the jaws are retracted. FIGS. 9 and 10*a*-10*c* show a suitable jaw latch mechanism comprising a hook 150 pivotally mounted on one of the jaws 24*a* and arranged to be engageable with a latch pin 152 on the other of the jaws 24*b* tri latch them closed. The hook 150 is coupled to a latch rod 154 which is mounted to the sliding casing 34 in a manner which permits it to move longitudinally, its upper end being elbowed to form a laterally projecting spring arm 156. A peg 157 is provided on an inner face of the housing 12 and arranged to engage the spring arm 156. Initially, following manual closing of the jaw arrangement 22, the spring arm 156 lies beneath the peg 157 (FIG. 10*a*) and maintains the hook 150 in its "latched" position. However as the sliding casing 34 is retracted into the housing 12, the spring arm is forced past the peg 157, releasing the latch mechanism so that the jaws can be subsequently be opened for use.

The liner 33 may be blind-ended. That is, the end of the liner 33 for insertion into the mouth 28 is closed. Also this end of the liner may be provided with a grippable feature 159 with which the paddles can engage to entrain the liner 33.

It is desirable to minimise external dimensions of the device to make it as convenient as possible for carrying. To this end the paddles 64 may be formed in a manner which allows them to "feather" on their return path, lying against the belts 44, 46 on which they are carried and so minimising the volume within the device that needs to be provided for them. FIG. 3 omits most of the paddles 64 themselves, showing only pads 158 on which the paddles are to be mounted, but shows an internal guide plate 160 which causes the paddles 64, which may be formed of resilient material or could for example be mounted on the pads 158 through pivots, to lie down against the belts as they pass inclined guide surfaces 162.

It is desirable to prevent any material from escaping once it has been collected into the liner 33. In some embodiments the paddles 64 alone serve to retain the collected material. However means may be provided for forming a seal across the liner beneath the collected material. In one such embodiment (not illustrated) self adhesive strips are provided at intervals across the interior of the liner 33 and are positioned to be pressed together by the paddles 64 to form the desired seal. An alternative is to provide the collection device with means for heat sealing the liner 33 after it has been advanced. Another alternative is to use zips, e.g. of the moulded plastics variety, at intervals along the liner to close it.

Heat sealing may be achieved by providing the paddles 64 with heating elements on their outer edges. In this case the paddles may be arranged in parallel pairs closely spaced along the directions of travel of the belts on which they are carried, so that the leading paddle of a pair will serve to contain the collected material. The other paddle of the pair is provided with the heating element and follows the first. In this way the heating element is prevented from coming into close contact with the collected material.

While the above described embodiments provide for the housing to be opened to eject collected material, another possibility is to have the collected material fed out of the device. FIG. 11 illustrates the principle. The liner 33 is able to emerge through the top of the housing 12. The internal mechanism may for example be able to freewheel to allow the liner to be pulled through, or alternatively, repeated actuation of the mechanism may serve to eject the liner and the material collected in it.

The collection device 210 illustrated in FIGS. 12 to 15 differs from the above described collection device 10 in that certain parts of its mechanism are power operated rather than being manually operated. More specifically, the collection device 210 uses electric motors to drive (a) the opening and closing movement of the jaws and (b) advancement of the conveyor mechanism to draw collected material into the device. These two functions are independently power driven and, as will be explained further below, the sequence of operations can, in a motor driven version, be electronically controlled.

Details of the mechanism for driving opening and closing of the jaws are best seen in FIG. 12. This drawing shows a sliding casing 234 similar to the sliding casing 34 of the earlier described embodiment, and once more comprising hingedly coupled first and second casing parts 234*a*, 234*b*. Pivotally coupled to each casing part 234*a*, 234*b* is a respective jaw 224*a*, 224*b*. The conveyor mechanism of the second collection device 210 is not seen in the drawings but may be similar to that of the first collection device 10.

Also omitted from FIGS. 12 to 15 are (a) the external housing, item 12 in the drawings of the first collection device and (b) the mechanism that moves the sliding casing 234 within the housing to advance/retract the jaws. Again, these aspects of the second device 210 can match the corresponding features of the first device 10. In particular, advancement and retraction of the jaws and the sliding casing can be carried out using the manual lever arrangement and retractable handle of FIG. 4, although in other embodiments that function could also be motorised.

An electric motor 300 drives the jaws 224*a*, 224*b*. The motor is supplied with electric power by one or more batteries carried in the device's housing, but the adaptation of the housing to receive the batteries is conventional and is not shown in the drawings. Leading from the motor to each of the jaws 224*a*, 224*b* is a respective drive mechanism comprising a speed reducing gear train, to amplify the modest torque available from the motor 300, and a crank and pushrod arrangement leading to the jaws 224*a*, 224*b*. The gear trains use a worm 302 carried on a shaft 304 of the electric motor 300 to drive a toothed worm wheel 306. A pinion 307 which is coaxial with the worm wheel 306 and mounted to rotate along with it drives first and second crank gears 308*a*, 308*b* carried by respective casing parts 234*a*, 234*b*.

The first crank gear 308*a* carried by the first casing part 234*a* serves as a crank by virtue of a pivotal coupling 310*a* to a first pushrod 312*a*. The pushrod has a further pivotal coupling 314*a* to the first jaw 224*a*, this coupling being offset from pivot 316*a* by which the jaw is mounted. When the motor shaft 304 turns, the first crank gear 308*a* turns along with it and drives the first pushrod 312*a* reciprocally to move the first jaw 224*a* between its closed and open positions.

Gearing carried by the second casing part 234*b* differs from that carried by first casing part 234*a* only in that it additionally incorporates a reversing gear 313 between second crank gear 308*b* and pinion 307. This is needed in order that the first and second crank gears 308*a*, 308*b* rotate in opposite directions. A second pushrod 312*b* couples the second crank gear 308*b* to the second jaw 224*b* to move it between its closed and open positions, and of course the gearing is arranged such that the jaws 224*a*, 224*b* open and close in unison.

The pushrods 312*a*, 312*b* incorporate respective resilient couplings 320*a, b* which serve to protect the jaw drive mechanism from damage. If for some reason excessive force is applied to the jaws 224*a,b*, tending to open or close them, the resilient couplings 320*a, b* allow the jaws to move independently of their drive mechanisms, to avoid overloading them. FIG. 13 shows one of the resilient couplings 320, which in this particular embodiment uses a pair of pre-stressed helical springs acting in opposition to one another. The pushrod 312 is broken into two parts 322, 324. A peg 326 carried by one pushrod part 322 projects through a slot 328 (see FIG. 12) in the other pushrod part 324. The two springs 330, 332 each couple to the peg 326 and extend from it in opposite directions to respective further pegs 334, 336 carried by the other push-rod part 324. If force on the pushrod 312, in either direction along its length, exceeds the force with which the springs 330, 332 are pre-stressed then the pushrod 312 yields, its length changing as its two parts slide relative to one another, allowing the corresponding jaw 224*a* or *b* to move. Clearly the required resilience could be incorporated into the drive mechanism in numerous other ways.

In the present embodiment the jaws 224*a,b* are hinged about shafts 316*a, b* which coincide with centre lines of the respective conveyor belts 364*a,b*, which can just be seen in FIG. 14, so that the length of the conveyor's path does not change significantly as the jaws 224*a,b* move. Consequently tensioning springs 60*a, b* of the first embodiment can be dispensed with.

The mechanism for driving the conveyor is seen in FIG. 14 and comprises a second electric motor 350 whose shaft 352 carries a worm 354 for driving a worm wheel 356 and a pinion 358 coaxial with the worm wheel. The first casing part 234*a* has a first conveyor drive gear 360*a* which meshes with the pinion 358 and which is mounted on a first conveyor shaft 362*a* which drives a first conveyor arrangement one of whose belts can be seen at 364*a* in the drawing. The gear train leading to second conveyor shaft 362*b* carried by the second casing part 234*b* is different in that it includes a reversing gear 366, in order that conveyor shafts 362*a,b* rotate in opposite directions.

In the first described collection device 10, a latch mechanism is provided to lock the conveyor mechanisms when the user opens the sliding casing 34, to prevent the respective conveyor mechanisms carried by the casing parts 34*a*, 34*b* from becoming misaligned with one another. The second collection device 210 does not require any such latching mechanism because as its casing 234 is opened the gear trains for driving the jaws and the conveyors do not disengage. Looking again at FIG. 12, for example, the axis of the pinion 307 coincides with the axis of a hinge coupling the two casing parts 234*a, b*. As the casing parts pivot about this axis relative to one another, the first crank gear 308*a* and the reversing gear 313 describe circular arcs about the axis, and so stay in mesh with the pinion 307. FIG. 15 shows that the pinion 307 and the pinion 358 are carried on the same shaft 366 that serves as the hinge coupling the two casing parts 234*a, b*, although to allow the two pinions to rotate independently the shaft is formed in two concentric parts 368, 370, one being received in the other.

The motorised mechanisms are controlled by user-operable switches (not shown) carried on the handle, which may, in the present embodiment, be generally similar in construction to the handle 18 of the first embodiment. A jaw control switch can be moved by the user between forward, reverse and off positions, running the jaw actuating motor 300 in one direction to open the jaws and in the opposite direction to close them. Limit switches or sensors of other type (not shown) are provided to detect when the limit of the jaws' travel in either direction has been reached, and to turn off the motor 300 in response. The limit switches may engage with the gearing or with the jaws 224*a, b*.

A user-operable conveyor switch (not shown) is carried by the handle and is actuable by the user to activate the conveyor motor 350.

A logic circuit is provided, receiving signals from sensors/switches, to ensure that operations are carried out in appropriate sequence, for example by (a) detecting when a pair of paddles are positioned adjacent each other at the bottom of the jaws 224*a,b*, ready to collect the next load of waste material, and stopping the conveyor motor 350 in response; (b) detecting when a bag is inserted; (c) detecting whether the jaws are retracted and preventing the jaw actuating motor 300 from running when they are etc. The logic circuit may comprise discrete electronic components, a suitable arrangement of switches, and/or programmed microprocessor. Its design would be straightforward for the skilled person and details are not provided herein.

The collection device 210 uses a rack and pinion arrangement (not shown) to drive advancement and retraction of the jaws, as in the earlier embodiment, but an alternative is to motorise that function as well. For example a switch or sensor may be provided to detect when the handle is collapsed and to retract the jaws in response.

FIGS. 16 to 18 show alternative means for packaging and for installing the liner used to prevent the components of the device from contacting the material being collected. A frame 400 carries the liner 402. FIG. 16 shows the frame on its own and in the present embodiment it comprises flat sheet material forming a rectangular shape with an opening 404 and a pull tab 406. The preferred material for the frame 400 is cardboard but plastics sheet or other suitable materials may be used. As supplied to a user, the liner 402 is carried upon the frame in a compact state, being concertinaed or otherwise crushed to lie adjacent the frame (FIG. 18). The liner's mouth is attached to the frame 400, surrounding the opening 404, as can be appreciated from FIG. 17. This attachment can be formed by bonding. Housing 412 has a slot 410 in one of its side faces, into which the frame and liner 400,402 in the compact state can be inserted, and the housing has internal features (not seen) such as rails to receive and locate the frame 400. A waisted portion 411 of the pull tab 406 clips into a recess 413 in the periphery of the slot 410 to keep the frame and liner in place. A hinged sealed cover (not shown) can trap the pull tab 406 and close the slot 410 to seal any odours in the housing. To insert the frame and liner 400,402 into the housing 412, the jaws 24*a*, 24*b* or 224*a*, 224*b* must be retracted, in which state they lie above the frame 400. When the jaws are advanced, they move through the opening 404 in the frame 400, drawing the liner 402 with them so that the jaws are covered by the liner 402. The liner needs to pass back into the mouth 28 formed by the jaws 24*a, b*, 224*a, b* to enable it to be drawn into the device by the conveyors (refer again for example to FIG. 2*a*, which shows the liner 33 in a suitable configuration) but this can be easily achieved either by having the user push the liner into the mouth 28, or simply by the effect of the material 70 being collected (see FIG. 2*a* again) which presses the liner into the mouth 28. Note that in the present embodiment the liner 402 is formed in the manner of a bag, having a closed end 414. A liner of this type may be formed to permit only a small number of collection operations—e.g. two—before it must be replaced. In this case the conveyors of the collection device may need only a corresponding number of paddles. After collection of material the pull tab 406 can be torn off the framed 400 to pull tight a drawstring 416, preventing release of the collected material.

It is to be understood that the collection device described above serves as an example only of how the invention can be put into practice. Some variants will now be described.

While the above described devices are intended particularly for collection of animal faeces, embodiments of the present invention may be put to any of a range of other uses. There are other situations which require collection of material without contamination of the collection device. Hazardous waste may require such treatment, for example. While the illustrated embodiments are manually actuated, others could use powered means to provide the required actions.

The liner 33, 402 may have a surface that is textured or spiky, or may have an adhesive surface to assist in collection. The paddles may have edges that are gapped, serrated (subject to their being suitably shaped not to damage the liner) or otherwise shaped to assist in collection of material. They may have flexible fingers to allow the contours of an uneven surface. They may incorporate magnets to draw pairs of paddles together, improving the seal across the liner 33, 402. The paddles may be formed from a range of materials such as rubber, metal or plastics. It is preferred that the belts and the paddles should be formed from a single piece moulding. One pair of paddles may be followed, after a short space along the conveyor, by another, so that the two pairs of paddles form a double seal against escape of material.

The toothed belts 44, 46 could in other embodiments be replaced by for example chain, flat belts V belts etc. While the mechanism used to advance the liner and the collected material into the housing is referred to as "conveyor" at various points herein, this implies merely that it is able to convey the liner and collected material into the housing and does not necessarily require the use of chains or belts. For instance the liner could be advanced by rollers, or grabbed and pulled by a reciprocating device.

Many variations in the construction and operation of the collection device are possible, within the scope of the present invention. For example, FIGS. 19, 20 and 21 show a generally cylindrical collection device 510 embodying the present invention. In this embodiment housing 512 is a hollow cylindrical body and carries a set of jaws 524 which are equiangularly spaced about the housing's central axis. The illustrated example has eight jaws 524 but a different number of jaws could be used. Each jaw 524 has its own conveyor 544 carrying paddles 564 which are triangular in shape and which tessellate when the jaws 524 are closed (FIG. 21) to close the device's mouth and collect material into it. As in previous embodiments the collection device 510 has a liner to cover the jaws and protect them from contact with the collected material. The liner is omitted from FIGS. 19 to 21. The jaws 524 are coupled by gearing or some other actuating mechanism (not shown) to open and close in unison, and as in the earlier described embodiments once the jaws have been closed to collect waste material it is drawn into the housing 512 by the conveyors 544. In the present embodiment the jaws 524 and the conveyors 544 are driven by electric motors via orbital gears housed in the top of the device's sliding casing 534. The jaws 524 are supported by brackets 600 cantilevered from the sliding casing 534. A switch 602 on an upper part of the housing 512 releases telescopic handle 518 to allow the housing 512 to be lowered to ground level and to open twin flaps 532 and advance the jaws 524. The housing 512 is formed in two parts hinged to one another about line 606 in FIG. 19. Depressing a release button 604 allows the two parts of the housing to be opened about the hinge to allow collected material to be removed.

In other variants of the collection device a single movable jaw could be used. It could, for example, be opposed by a static jaw.

The invention claimed is:

1. A device for collecting material from a surface, the device comprising a housing for receiving collected material, a jaw arrangement which is configured to open to provide a mouth for receiving the material and to close to collect the material, and a conveyor mechanism comprising at least one belt or chain passed around a member mounted on a movable jaw of the jaw arrangement so that the belt or chain is moved along with the jaws as they open and close, which is operable when the jaw arrangement is closed to advance a liner, placed over the jaw arrangement to separate it from the material being collected, so that in use the jaw arrangement is operable to be closed around the material to be collected and then the conveyor mechanism is operable to advance the liner and the material collected in it through the mouth and into the housing, the collected material being retained in the liner without making contact with surfaces of the device.

2. A device as claimed in claim 1 in which the jaw arrangement is operable independently of the conveyor mechanism so that the jaw arrangement is able to be opened and closed without advancing the liner.

3. A device as claimed in claim 1 in which the conveyor mechanism is adapted to advance a predetermined distance each time it is operated.

4. A device as claimed in claim 3 in which the belt or chain carries at least one paddle for collecting material.

5. A device as claimed in claim 4 comprising at least one pair of belts or chains separated from one another and linked by the paddle.

6. A device as claimed in claim 1 comprising at least two belts or chains each carrying a plurality of paddles positioned to contact one another upon closure of the jaw arrangement to collect material.

7. A device as claimed in claim 1 in which the yaw arrangement is retractable into the housing.

8. A device as claimed in claim 7 in which the jaw arrangement is carried upon a sliding assembly within the housing.

9. A device as claimed in claim 8 in which the sliding assembly comprises a sliding casing into which the liner is advanced by the conveyor mechanism.

10. A device as claimed in claim 9 further comprising a mechanism for moving the sliding assembly in a reciprocating motion.

11. A device as claimed in claim 10 in which movement of the sliding assembly causes the conveyor mechanism to advance.

12. A device as claimed in claim 11 further comprising a rack and pinion mechanism arranged to drive the conveyor mechanism as the sliding assembly is moved.

13. A device as claimed in claim 1 in which the housing is formed in two parts enabling it to be opened to remove collected material.

14. A device for collecting material from a surface, the device comprising a housing for receiving collected material, a jaw arrangement which is configured to open to provide a mouth for receiving the material and to close to collect the material, said jaw arrangement comprising an opposed pair of pivotally movable jaws and a mechanism for moving both jaws simultaneously in opposite rotational directions, and a conveyor mechanism comprising at least one heft or chain which is operable when the jaw arrangement is closed to advance a liner, placed over the jaw arrangement to separate it from the material being collected, so that in use the jaw arrangement is operable to be closed around the material to be collected and then the conveyor mechanism is operable to advance the liner and the material collected in it through the mouth and into the housing, the collected material being retained in the liner without making contact with surfaces of the device.

15. A device for collecting material from a surface, the device comprising a housing for receiving collected material, a jaw arrangement which is configured to open to provide a mouth for receiving the material and to close to collect the material, and a conveyor mechanism which is adapted to advance a predetermined distance each time it is operated, said conveyer mechanism comprising at least one pair of belts or chains carrying at least one paddle for collecting material, said pair of belts or chains being separated from one another and linked by the paddle, said conveyor mechanism being, operable when the jaw arrangement is closed to advance a liner placed over the jaw arrangement to separate it from the material being collected, so that in use the jaw arrangement is operable to be closed around the material to be collected and then the conveyor mechanism is operable to advance the liner and the material collected in it through the mouth and into the housing, the collected material being retained in the liner without making contact with surfaces of the device.

16. A device for collecting material from a surface, the device comprising a housing for receiving, collected material, a jaw arrangement which is configured to open to provide a mouth for receiving the material and to close to collect the material, and a conveyor mechanism comprising at least two belts or chains, each carrying a plurality of paddles positioned to contact one another upon closure of the jaw arrangement to collect material, said conveyor mechanism being operable when the jaw arrangement is closed to advance a liner placed over the jaw arrangement to separate it from the material being collected, so that in use the jaw arrangement is operable to be closed around the material to be collected and then the conveyor mechanism is operable to advance the liner and the material collected in it through the mouth and into the housing, the collected material being retained in the liner without making contact with surfaces of the device.

17. A device for collecting material from a surface, the device comprising a housing for receiving collected material, a jaw arrangement that is carried upon a sliding assembly within the housing and retractable into the housing, jaw arrangement being configured to open to provide a mouth for receiving the material and to close to collect the material, and a conveyor mechanism comprising at least one belt or chain which is operable when the jaw arrangement is closed to advance a liner, placed over the jaw arrangement to separate it from the material being collected, so that in use the jaw arrangement is operable to be closed around the material to be collected and then the conveyor mechanism is operable to advance the liner and the material collected in it through the mouth and into the housing, the collected material being retained in the liner without making contact with surfaces of the device.

* * * * *